US011919733B2

(12) United States Patent
Barten et al.

(10) Patent No.: US 11,919,733 B2
(45) Date of Patent: Mar. 5, 2024

(54) REEL FOR WINDING OR UNWINDING STRIP-SHAPED MATERIAL AND METHOD

(71) Applicant: Achenbach Buschhütten GmbH & Co. KG, Kreuztal (DE)

(72) Inventors: Andrè Barten, Siegen (DE); Christian Schneider, Olpe (DE); Felix Menn, Hilchenbach (DE); Harald Schlag, Kreuztal (DE)

(73) Assignee: ACHENBACH BUSCHHÜTTEN GMBH & CO. KG, Kueuztal (DE)

( * ) Notice: Subject to any disclaimer, the term of this patent is extended or adjusted under 35 U.S.C. 154(b) by 0 days.

(21) Appl. No.: 18/273,485

(22) PCT Filed: Dec. 9, 2021

(86) PCT No.: PCT/EP2021/084948

§ 371 (c)(1),
(2) Date: Jul. 20, 2023

(87) PCT Pub. No.: WO2022/156955

PCT Pub. Date: Jul. 28, 2022

(65) Prior Publication Data

US 2024/0043233 A1 Feb. 8, 2024

(30) Foreign Application Priority Data

Jan. 25, 2021 (DE) ..... 10 2021 101 530.8

(51) Int. Cl.
*B65H 18/10* (2006.01)

(52) U.S. Cl.
CPC ..... *B65H 18/10* (2013.01); *B65H 2403/923* (2013.01); *B65H 2515/31* (2013.01); *B65H 2701/173* (2013.01)

(58) Field of Classification Search
CPC ..... B65H 18/10; B65H 19/12; B65H 19/126; B65H 2701/173; B65H 2405/454
See application file for complete search history.

(56) References Cited

U.S. PATENT DOCUMENTS 5,695,150 A * 12/1997 Chevet ..... B21C 47/02 242/909
5,904,313 A * 5/1999 Perret ..... B21C 47/245 242/909

(Continued)

FOREIGN PATENT DOCUMENTS

EP 2896465 A1 7/2015
EP 3731384 A1 10/2020

OTHER PUBLICATIONS

PCT International Search Report, PCT/EP2021/084948, dated Jul. 18, 2022, 9 pages.

(Continued)

*Primary Examiner* — Sang K Kim
(74) *Attorney, Agent, or Firm* — Quarles & Brady LLP; Yakov S. Sidorin

(57) ABSTRACT

The invention relates to a reel (10) for winding or unwinding strip-shaped material, in particular a metal strip or the like, and to a method for tensioning a coil (12), the reel comprising a frame (13), at least one reel head (14) for disposing the coil for winding or unwinding material (11), a drive arrangement (15) having at least one electric motor (16) and a shaft (20) which connects the electric motor to the reel head, the electric motor being formed comprising a stator (17) and a rotor (18) and being disposed on the frame, the electric motor being a torque motor or a synchronous motor, the shaft directly connecting the rotor to the reel head, the rotor being mounted on the stator so as to be axially displaceable relative to the stator.

20 Claims, 4 Drawing Sheets

(56) References Cited

U.S. PATENT DOCUMENTS

| | | | | |
|---|---|---|---|---|
| 6,293,132 | B1 * | 9/2001 | Drigani | B21C 47/245 72/202 |
| 8,002,215 | B2 * | 8/2011 | Repp | B65H 19/12 242/596.7 |
| 8,523,100 | B2 * | 9/2013 | Westphal | B65H 75/245 242/573.7 |

OTHER PUBLICATIONS

PCT Written Opinion, PCT/EP2021/084948, dated Jul. 18, 2022, 12 pages.

* cited by examiner

REEL FOR WINDING OR UNWINDING STRIP-SHAPED MATERIAL AND METHOD

This patent application is a US national phase of pending International Patent Application No. PCT/EP2021/084948 filed on Dec. 9, 2021, which claims priority from the German Patent Application No. 10 2021 101 530.8 filed on Jan. 25, 2021 and which is now published as WO 2022/156955. The disclosure of each of the above-identified patent applications is incorporated herein by reference.

The invention relates to a reel for winding or unwinding strip-shaped material, in particular a metal strip or the like, and a method for tensioning a coil, the reel comprising a frame, at least one reel head for disposing a coil for winding or unwinding material, a drive arrangement with at least one electric motor and a shaft connecting the electric motor to the reel head, the electric motor being formed with a stator and with a rotor and being disposed on the frame.

Reels of the type mentioned above are used, for example, in strip production in a rolling method, where the strip is commonly unwound from a first reel with a defined strip tension in a one-way or reversing operation, moved through a rolling gap of a rolling device and wound onto an additional reel with a defined strip tension. In a subsequent rolling pass, the strip can then be wound up on the reel after repeatedly passing through the rolling device several times, when the desired rolled strip thickness has been reached. The strip-shaped material is disposed in the form of a coil or as a coil that has undergone a hot rolling process on a coil or on a cardboard sleeve, which is received by a reel mandrel or reel head. The coil can be stretched on the reel head, which can be designed as an expansion head or cone head, or reel heads can be provided on both sides of the coil to accommodate the coil between them.

The reel head(s) are each disposed on a shaft, which is mounted on a reel winder. The shaft is connected to an electric motor via a gearbox. Several electric motors can be coupled to the gearbox to achieve different power increments. The shaft can be displaceably mounted on the reel winder along a longitudinal axis of the shaft so that the coil can be accommodated between two reel heads. The electric motor, the gearbox, possibly a coupling, and a frame on which these components are attached thus form a reel. Such a reel is known, for example, from EP 2 896 465 B1.

In the known reels, the strip-shaped material is wound up with a defined strip tension or a tensile force formed in the strip by the reel. This tensile force is set by a control device of the reel, in particular by controlling the electric motor. For control purposes, a torque of the electric motor is calculated, from which a torque of the reel head or the coil can then be determined. The torque can be determined, for example, from a power input of the electric motor and its current speed. However, since a gearbox, a coupling and possibly an intermediate shaft are interposed between the electric motor and the reel head, the torque arriving at the reel head may be reduced, for example because of the efficiency of the gearbox.

A disadvantage of the known reels is that they require a comparatively large installation space in a production facility because of their design. Furthermore, each reel is always produced for a specific application and thus produced individually. The electric motor, the gearbox, the coupling and the reel winder having the reel head are therefore always coordinated, such that, for example, a power increase of the reel by a more powerful electric motor usually requires an increase of the drive train and is therefore hardly economically feasible.

The object of the invention is to propose a reel and a method for tensioning a coil that allows particularly cost-effective manufacture and operation.

This object is attained by a reel having the features of claim 1, a modular system having the features of claim 13 and a method having the features of claim 14.

The reel according to the invention for winding or unwinding strip-shaped material, in particular a metal strip or the like, comprises a frame, at least one reel head for disposing a coil for winding material, a drive arrangement having at least one electric motor, and a shaft which connects the electric motor to the reel head, the electric motor being formed comprising a stator and a rotor and being disposed on the frame, the electric motor being a torque motor or synchronous motor, the shaft connecting the rotor directly to the reel head, the rotor being mounted on the stator so as to be axially displaceable relative to the stator.

Because the electric motor is a torque motor or a synchronous motor, it is possible to connect the reel head directly to the rotor via the shaft. Since the electric motor can generate a comparatively high torque, it is no longer necessary to provide a gearbox that is interposed between an electric motor and a reel winder. Furthermore, a coupling, necessary motor bearings and the reel winder itself can be omitted. The frame or a foundation required for the frame at a production site can thus be substantially reduced in size. In particular, an installation space for the reel and a size of the frame are then determined solely by the dimensions of the electric motor integrated in the reel winder and the reel head. As a large part of the originally required installation space and thus of the foundation can be saved, the reel can be manufactured particularly cost-effectively and operated in an energy-efficient manner.

According to the invention, the rotor is mounted on the stator so as to be axially displaceable relative to the stator. The axial displaceability of the rotor relative to the stator can be realized by the rotor being mounted on the stator so as to be axially displaceable. The electric motor can thus be used like a reel winder known from prior art. A coil can then be clamped particularly easily between two reel heads, or a reel head can be adapted to a length or position of a coil relative to the longitudinal axis of a shaft.

Furthermore, the rotor is formed from a ring package, which in turn is composed of a plurality of rings. On each of the rings, magnets are disposed at a circumference of the respective ring or in insertion pockets directly below the circumference of the ring. A size of the magnets is limited to the dimensions of the respective ring, i.e., the magnets are not disposed on the rings so as to protrude beyond them. The rings themselves can be composed of discs or of metal sheets. The rings are directly or indirectly connected to each other. For example, the rings can be screwed together, i.e., detachably connected to each other. Furthermore, the rings can also be directly attached to the shaft or to a rotor carrier disposed between the shaft and an inner diameter of the rings. The stator can surround the rotor, and the rotor can also surround the stator, in principle. By using several rings to form the rotor, it is possible for the electric motor to have a modular design. A number of rings can always be selected so that an electric motor is formed with a desired power without having to change the stator. It is therefore possible to produce electric motors having different power levels using one stator. The production of individually designed reels can thus be standardized and is thus particularly cost-effective.

The drive arrangement can be gearless. This makes the production of the reel even more cost-effective. In particular, a gear oil system is also not required in this case. The efficiency of the reel can also be improved, as there are no friction losses due to an existing gearbox. Furthermore, noise emissions from the reel are significantly reduced. Overall, the reel also requires less maintenance because it has fewer components.

The stator may be formed from a coil package having a plurality of coils and surround the rotor, the rotor being formed from a ring package having a plurality of rings, each having magnets on a circumference of the respective ring, the rings being connected to each other, a length $L_R$ of the ring package being smaller than the length $L_W$ of the coil package relative to a longitudinal axis of the shaft, and a displacement range V of the rotor corresponding to a difference $V=L_W-L_R$ of the lengths. Consequently, the rotor can be formed as an inrunner. The stator can be formed by a stack of annular metal sheets in which the coils are integrally disposed. The annular metal sheets may be surrounded by a frame to which they are fastened. Furthermore, the frame may be formed having channels or pipes through which a cooling medium flows. If a length of the ring package is smaller than a length of the coil package, it is possible to easily achieve a power enhancement of the electric motor by adding a ring to the ring package. The length of the coil package can always be the same for all electric motors used to form a reel, the power of the electric motor individually required for each reel being adjustable by selecting the length of the ring package. It is advantageous to standardize a length of the stator or its coil package. If the length of the rotor package and the length of the coil package are essentially the same, no additional rings can be added to the electric motor. The possibility to axially displace the rotor is then given by the fact that the length of the coil package is greater than the length of the ring package. The displacement range resulting from the difference in the lengths allows the rotor to be displaced within this displacement range without such a displacement resulting in a change in power of the electric motor. This can be ensured in particular by ensuring that the ring package is always covered by the coil package within the displacement range during operation.

The drive arrangement can comprise at least one electric motor, each electric motor comprising a frame and a reel head, a coil being disposed between the reel heads, the respective coil packages of the electric motors having a corresponding length $L_W$. Consequently, an electric motor can be disposed on both sides of the coil. If the respective coil packages of the electric motors have a corresponding length, the respective stator of the electric motors is designed to essentially correspond. The electric motors can then be designed to be essentially identical or with different rotors. Since the coil packages do not have to be designed differently to form electric motors of different power, the electric motors can be manufactured and maintained more easily. Costs can also be saved by manufacturing the same stators in large quantities. Each of the electric motors can be disposed on or attached to an intended frame, the electric motors also being able to be disposed on a joint frame. The coil, which is then disposed between the electric motors or the respective reel heads, can be moved on a carriage, which is guided on rails, for example, transverse to a longitudinal axis of the two shafts of the electric motors. A conveyor track formed in this way for the carriage can be disposed on a foundation formed specifically for this purpose.

The power of the electric motors can differ or be the same in size. The electric motors can be operated synchronously when winding strip-shaped material. Furthermore, it is possible to operate only one of the two electric motors if a lower power is required. If the electric motors are torque motors or synchronous motors, an input power of the respective electric motors can be switched electrically between two inverters if required, so that two or more power levels of the respective electric motors can be formed. Depending on the total reel power required, the respective individual powers of the electric motors can be designed accordingly and therefore be the same in size or differ in size.

A length $L_R$ of the respective ring packages of the electric motors can differ in size. The length of the ring package determines a mass of magnets on a circumference of the respective ring packages, and thus a power of the respective electric motors. Electric motors with differing powers can be easily formed based on the length of the respective ring packages.

The rings can differ from each other in width or be identical in width. Since a ring package is formed from a plurality of rings, it is thus possible to affect the length of the ring package. This can be carried out by using a certain number of rings to form the desired length, and thus the power the electric motor. The rings used can have a corresponding width or a width that differs from each other. If a selection of rings having different widths is available, it is possible to provide a larger number of possible lengths of the ring package when forming an electric motor. A large possible variation of a length of the ring package results if the ring package can be composed of a number of rings with two or three different widths.

The drive arrangement can comprise a tensioning device having an actuator, the rotor being axially displaceable relative to the stator by means of the actuator. The actuator can be, for example, a hydraulically or pneumatically driven piston or a linear motor. The actuator can be coupled to the shaft of the electric motor in such a way that a movement of the actuator causes a displacement of the shaft along the longitudinal axis. Since the rotor can then be displaced relative to the stator by means of the actuator, the reel head can also be displaced along the longitudinal axis. It is then possible to place a coil between reel heads and to tension the coil at the reel heads or to move the reel heads into the coil and/or to form a tension force between the reel heads and the coil.

The rotor can be disposed on the shaft and mounted on a housing of the stator by means of radial bearings and at least one axial bearing, a longitudinal guide being formed between each of the bearings and the housing on either side of the rotor relative to a longitudinal axis of the shaft. The bearings can be plain bearings and/or rolling bearings, preferably. The rolling bearings can be, for example, deep groove ball bearings, so that the bearings can absorb axial and radial forces. In this case, the radial bearing and the axial bearing can be formed by a single bearing. The longitudinal guide can be formed, for example, by a sleeve that is movable in the direction of the longitudinal axis in a bushing. However, other types of longitudinal guides may also be used. The sleeve can be part of the housing of the stator and the rotor is then rotatably mounted on the sleeve via the radial bearings or the axial bearing. Preferably, the shaft can be mounted on the housing on both sides of the rotor. It is thus possible that the rotor is rotatable relative to the stator and at the same time movable along the longitudinal axis of the shaft, together with the shaft. A longitudinal guide of this kind can be formed particularly easily. The actuator can then also be connected to the bushing. It can also be intended that the bushing is displaceable in the sleeve only in an axial direction. In principle, in addition to a circular sleeve or bushing, any cross-sectional shape can be provided to form such a longitudinal guide.

The drive arrangement can comprise an additional actuator by means of which the electric motor can be axially displaceable on an additional longitudinal guide, which is formed on the frame, relative to the frame with respect to a longitudinal axis of the shaft. The additional actuator can be designed like the actuator and be disposed on a housing of the stator or on the frame. The additional actuator can then be coupled to, for example, a piston on the housing or the frame, so that a movement of the piston causes a relative movement of the frame and housing. An additional linear guide which allows a longitudinal displacement of the electric motor can be formed between the housing and the frame. If the drive arrangement comprises several electric motors, each of these electric motors can be designed so as to be longitudinally displaceable in this way. In particular, the displacement range of the electric motor can be significantly extended in this way, so that coils of different lengths can be accommodated on the reel.

The electric motor may be formed having a housing which can be attached to the frame, at least one force transducer of a sensing device of a control device of the reel being disposed between the housing and the frame. The control device can thus serve to control and regulate the reel and in particular the strip tension of the reel, which is formed by a strip tension force within a strip wound onto the coil by the reel. The electric motor causes a torque with the rotor which is transmitted via the shaft to the reel head and thus to the coil. Depending on the amount of material stored on the coil, the diameter of the coil can vary greatly, so that the strip tension is always dependent on this diameter. A regulating device of the control device can be designed in such a way that the relevant diameter is taken into account when regulating the strip tension force. In order to control the strip tensile force, a torque of the shaft can thus also be controlled by means of the control device. This is then commonly carried out by controlling the electric motor connected to the shaft. Since the electric motor is directly connected to the reel head via the shaft, without a gearbox, coupling or the like being connected in between in a drive train, it is possible to measure the torque that effectively acts on the reel head or the coil at the electric motor, since it can be assumed as a result of the direct power transmission that the torque is measured very precisely. The direct force transmission makes it possible to measure the torque by means of the force transducer, which is fastened between the housing of the electric motor and the frame on which the electric motor is attached. If the force transducer is fastened between the housing and the frame, a force that can be measured is applied to the force transducer through a torque caused on the shaft by the electric motor, the sensing device or the control device being able to determine the torque of the shaft from the measured values. Only the direct connection between the electric motor and the reel head via the shaft enables this type of torque measurement and thus a particularly precise control of the strip tension.

The force transducer can be designed to detect a compressive force and/or tensile force or a torque. The force transducer can be a sensor, in particular a force sensor, a load cell or load cell with which a force acting on the sensor can be measured. A force can be measured by means of a spring body, piezoelectrically, electromagnetically, electrodynamically or electroresistively. It can be intended that electroresistive sensors are not used, as they can be influenced by a magnetic field of the electric motor.

The force transducer can be disposed at a radial distance relative to a longitudinal axis of the shaft. From the radial distance of the force transducer relative to the shaft, a torque can be calculated simply from a force measured using the force transducer.

The force transducer can be designed to detect a compressive force and/or tensile force. Depending on the direction of rotation of the shaft in relation to a direction of the strip tensile force, the force transducer can be subjected to a compressive force or a tensile force. It is particularly advantageous if the force transducer can be used to determine a compressive force and also a tensile force.

The housing can be fixed to the frame at fastening points, a force transducer being able to be disposed on at least one fastening point. The fastening point can be formed, for example, by a screw connection between the housing and the frame. In principle, however, the fastening point can also be a support point of the housing on the frame.

It is particularly advantageous if force transducers are disposed on all fastening points. This makes it possible to detect all the forces acting between the housing and the frame and thus to determine a torque of the shaft particularly accurately. In principle, however, this is not necessary, since a torque can be determined just using a single force transducer if a distribution of the forces acting on the fastening points is known.

The force transducer can be disposed on a connecting flange of the housing and/or the frame. For example, the housing and the frame can each form a connecting flange, the connecting flanges being able to abut against each other and being firmly connectable to each other via a screw connection. The force transducer can then be disposed between these connecting flanges. This may suffice for a preload of a screw connection to act on the force transducer. The sensing device can be calibrated in such a way that this preload is not taken into account or does not falsify a measurement result of the force transducer. Optionally, it is also possible to dispose the force transducer on the connecting flanges in such a way that the force transducer is not positioned between the connecting flanges but spans over the connecting flanges. For this purpose, the force transducer can then be firmly fixed to both connecting flanges so that forces acting between the connecting flanges are also transmitted to the force transducer.

The drive arrangement can have two reel heads, each reel head being formed so as to have an expansion head or a cone for receiving the coil. In principle, it is also possible that the drive arrangement, if it only has one electric motor, is designed with a single expansion head. The expansion head can be designed such that it can be inserted into an opening at one end of a coil. Segments of the expansion head can then be clamped against an internal tension of the coil, so that the coil is tightly fastened in a force-fitting manner and centered on the expansion head. The movement of the segments can, for example, be effected hydraulically or by means of a drawbar. The cone can be designed to rest against one end of the coil so that the coil is clamped between two reel heads that can be moved against each other. In this case, the coil is also centered relative to the reel head.

The expansion head can have an expansion segment arrangement which has expansion segments and which is formed for radially tensioning the coil, at least one hydraulic line being formed or a drawbar for actuating the expansion segments being disposed within the shaft. The shaft can therefore be designed as a hollow shaft or a solid shaft. In principle, it is also possible to connect the expansion head directly, i.e. on the expansion head itself, to a hydraulic or mechanical actuation, so that the shaft is unaffected.

The modular system according to the invention for forming a reel according to the invention comprises a stator formed by a coil package having a plurality of coils and a plurality of rings, each having magnets on a circumference of the respective ring or in insertion pockets directly below the circumference of the ring, which serve to form a ring package of a rotor, the rings being selected from a first set of rings having a first width and from a second set of rings having a second width, which can differ from the first width. The modular system according to the invention allows the formation of ring packages having different lengths $L_R$, so that electric motors having differing powers can be assembled from these ring packages or modular systems. Because different sets of rings are available for the selection of rings, a high degree of variability can be achieved while at the same time reducing costs significantly. The production of rotors and electric motors can thus be standardized to a high degree and is therefore particularly cost-effective.

In the method according to the invention for tensioning a coil for winding or unwinding strip-shaped material, in particular a metal strip or the like, by means of a reel, a rotor is axially displaced relative to a stator of the electric motor on at least one electric motor of a drive arrangement of the reel by means of a tensioning device of the drive arrangement in such a manner that the coil, which is disposed between reel heads of the drive arrangement, is tensioned or released, the electric motor being a torque motor or a synchronous motor. For the advantageous effects of the method, reference is made to the description of advantages of the reel according to the invention.

The axial displacement can be used for a strip center control and/or a strip center alignment before or during a rolling operation. The strip center control is used to unwind the strip from a non-straight-edged coil during rolling and to guide it centrally through a rolling gap in order to wind it onto a coil in a straight-edged manner. Strip center alignment is used to center a coil that has not been wound in a straight-edged manner in a rolling line before rolling, so that the wound strip is guided centrally through the roll gap. A position of the strip can be determined by means of sensors. Data from the sensors can be used for controlling and thus for the axial displacement.

A reel according to the invention is used for carrying out the method according to the invention. Further advantageous embodiments of the method are apparent from the descriptions of features of the dependent claims referring back to device claim 1.

In the following, a preferred embodiment of the reel is explained in more detail with reference to the drawings.

Figure 1:
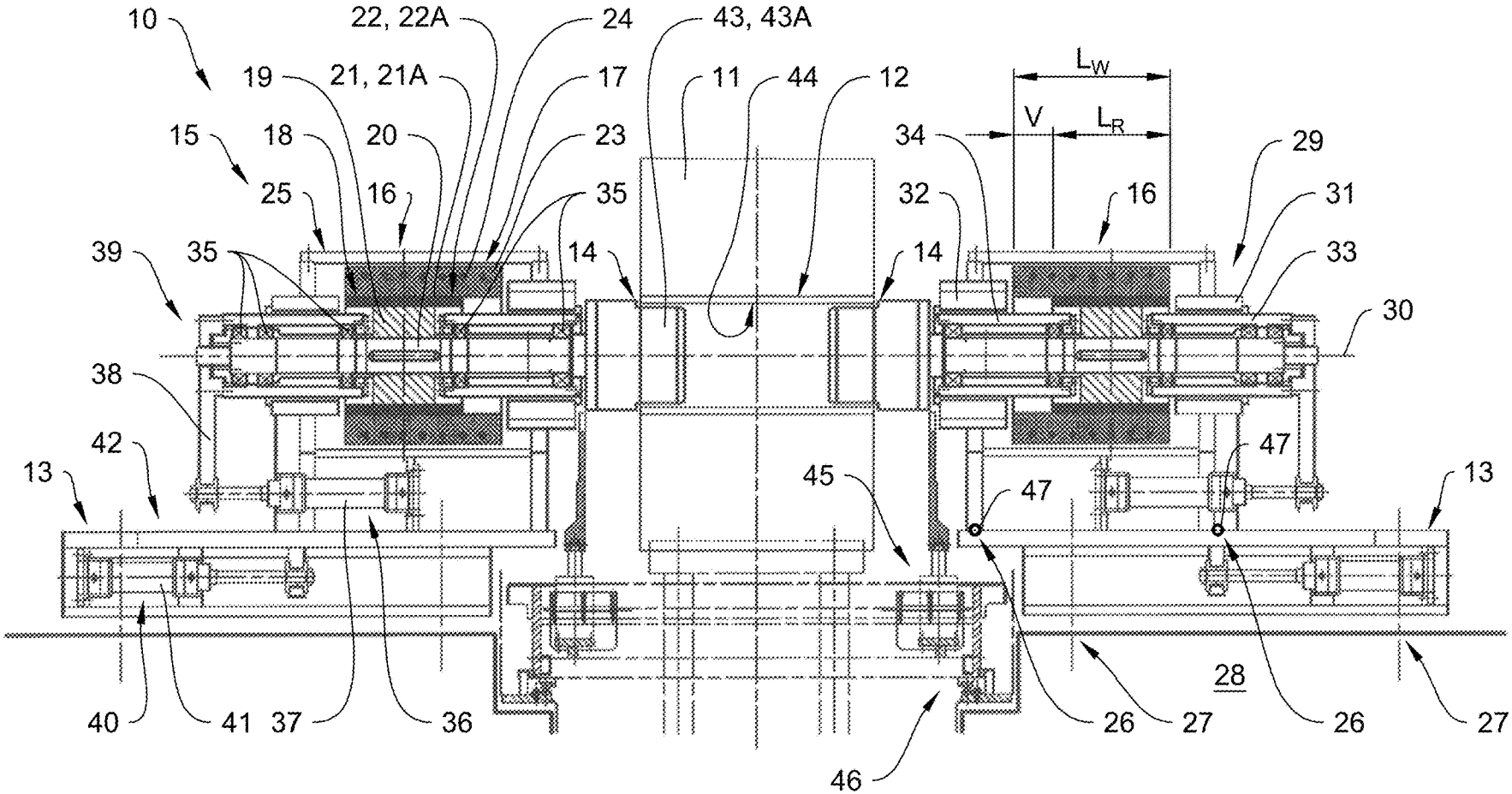
FIG. 1 shows a first embodiment of a reel in a longitudinal sectional view.

FIG. 1 shows a reel 10 for winding strip-shaped material 11 or a metal strip on a coil 12. The reel 10 comprises two essentially correspondingly designed frames 13, two correspondingly designed reel heads 14 for disposing the coil 12 and a drive arrangement 15, which comprises two correspondingly designed electric motors 16 or torque motors. Each of the electric motors 16 is formed by a stator 17 and a rotor 18, the stator 17 surrounding the rotor 18 and the rotor 18 being rotatably mounted within the stator 17. A rotor carrier 19 of the rotor 18 is non-rotatably disposed directly on a shaft 20 of the electric motor 16, the shaft 20 being directly connected to the reel head 14. Furthermore, the rotor 18 is formed from a ring package 21 consisting of a plurality of rings 21A, each having magnets 22A at a circumference 22 of the respective ring. These rings 21A are detachably connected to each other. The stator 17 is formed by a coil package 23 having a plurality of coils (not shown), which are surrounded by a frame (not shown). Cooling channels 24 are formed within this frame, through which a cooling medium (not shown) flows and which serve to cool the coil package 23. Passive cooling or surface cooling of the frame is also possible.

The electric motor 16 is further formed having a housing 25, which surrounds the rotor 18 and the stator 17. The housing 25 is firmly connected or screwed to the frame 13 at fastening points 26. The frame 13 is firmly connected to a foundation 28 at fastening points 27. Furthermore, the housing 25 is formed having a longitudinal guide 29 that allows axial displacement of the rotor 18 relative to the stator along a longitudinal axis 30 of the shaft 20. The longitudinal guide 29 is formed by sleeves 31 and 32, which are disposed on either side of the rotor 18, and bushings 33 and 34 surrounding the sleeves 31 and 32, respectively. The shaft 20 is mounted radially and axially within the sleeves 31 and 32 by means of rolling bearings 35. A displacement of the rotor 18 relative to the stator is possible within a displacement range V, the displacement range V resulting from a difference of a length $L_R$ of the ring package 21 and a length $L_W$ of the coil package 23. A possible displacement takes place by means of an actuator 36, which is formed by a hydraulic cylinder 37 in this case and which is coupled to the bushing 33 via a brace 38. The possibility of displacing the rotor 18 or the shaft 20 with the reel head 14 thus forms a tensioning device 39 for tensioning the coil 12 between the reel heads 14.

In particular, directly driving the coil 12 by the electric motors 16 makes it possible to significantly reduce the number of rotating parts of the reel 10 and to not require additional drive shafts, couplings or the like. A mechanical brake as a service brake on the reel is also not required since the electric motors 16 can be braked by a short circuit of the coils via a resistor in the event of a power failure or a converter fault.

Furthermore, a standstill brake is also not required since a short circuit of the coils can be used to hold the rotor in its position when it is at a standstill. By reducing the number of parts or modules of the reel 10, maintenance costs can be significantly reduced.

Furthermore, it is possible to adjust or increase the power of the electric motors 16 by adding rings even after the reel 10 has already been put into operation.

Drive arrangement 15 comprises an additional actuator 40, which is disposed on the frame 13 and formed by an additional hydraulic cylinder 41. The housing 25 is mounted on an additional longitudinal guide 42, which is formed on the frame 13, and is also axially displaceable in the longitudinal direction of the longitudinal axis by means of the additional actuator 40.

The reel heads 14 are each designed as an expansion head 43, which has expansion segments 43A which can be actuated via a hydraulic line or a drawbar (not shown in FIG. 1). The expansion segments can exert a clamping force on an inner side 44 of the coil 12 so that the coil 12 is centered and non-rotatably clamped on the respective expansion heads 43. The coil 12 having the material 11 can be transported to the reel 10 by means of a carriage 45, which can be moved on rails 46 transversely to the longitudinal axis 30.

Furthermore, force transducers 47 are disposed on the housing 25 or the fastening points 26 between the housing 25 and the frame 13. The force transducers 47 are a component of a control device (not shown). The control device serves to regulate a strip tension or a strip tension force of the reel 10 or a power and thus a torque of the electric motors 16. The control device comprises a regulating device for regulating the strip tension or the electric motors 16 and a sensing device 47, which comprises the force transducers, also denoted with the numeral 47. By placing the force transducers 47 between the frame 13 and the housing 25, it is possible to determine the forces acting between the frame 13 and the housing 25. Since the electric motors 16 are each directly connected to the coil 12 via the shaft 20 and the reel head 14, a torque of the respective electric motors 16 can be determined directly and thus particularly precisely via the force transducers 47 or the sensing device, which allows for improved control of the strip tension.

Figure 2:
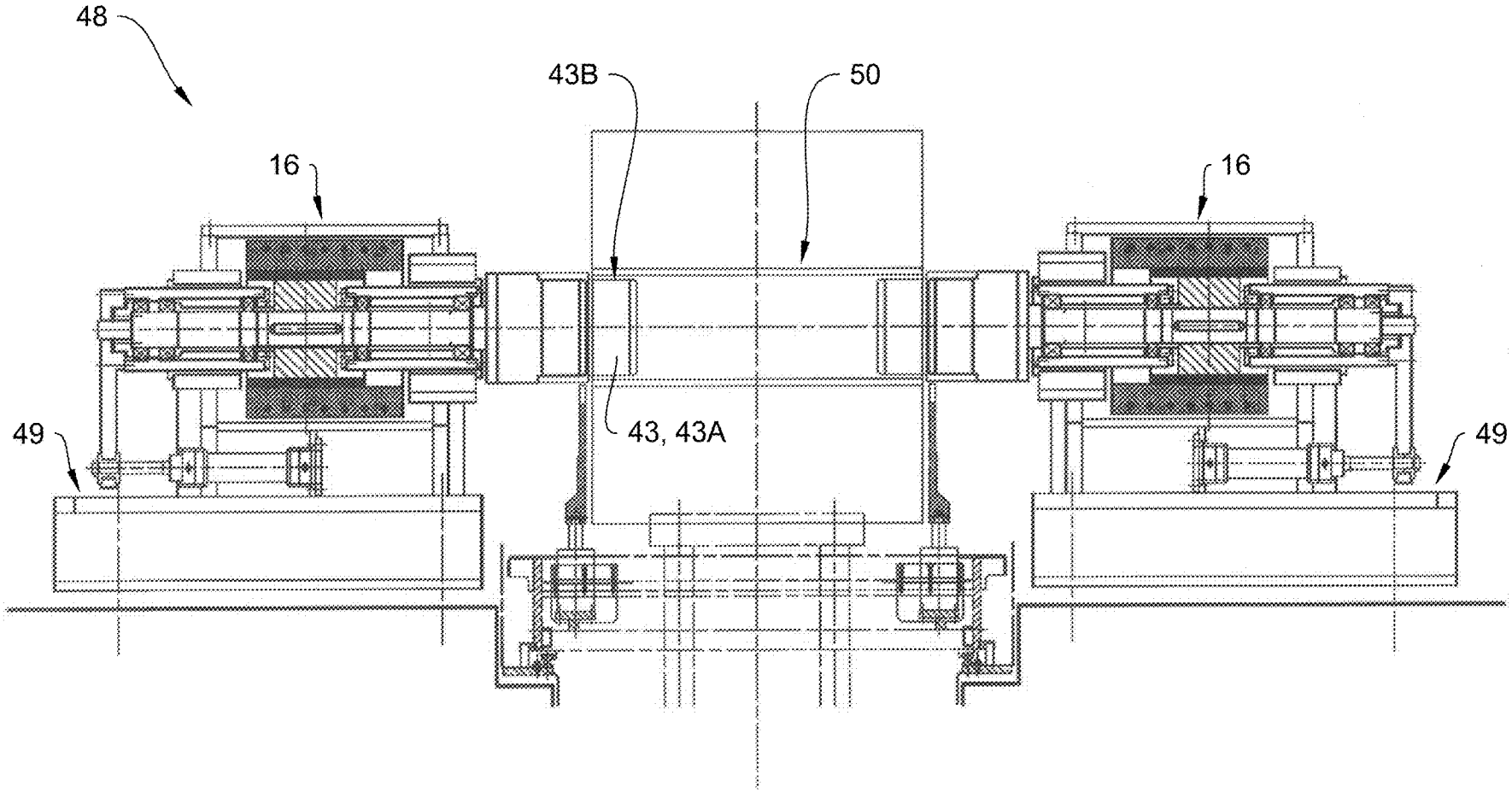
FIG. 2 shows a second embodiment of a reel in a longitudinal sectional view.

FIG. 2 shows a reel 48 in which, in contrast to the reel in FIG. 1, a frame 49 is formed without an additional longitudinal guide. In this case, the tensioning device 39 suffices for tensioning a coil 50. The hydraulic line or a drawbar is schematically indicated with a numeral 43B.

Figure 3:
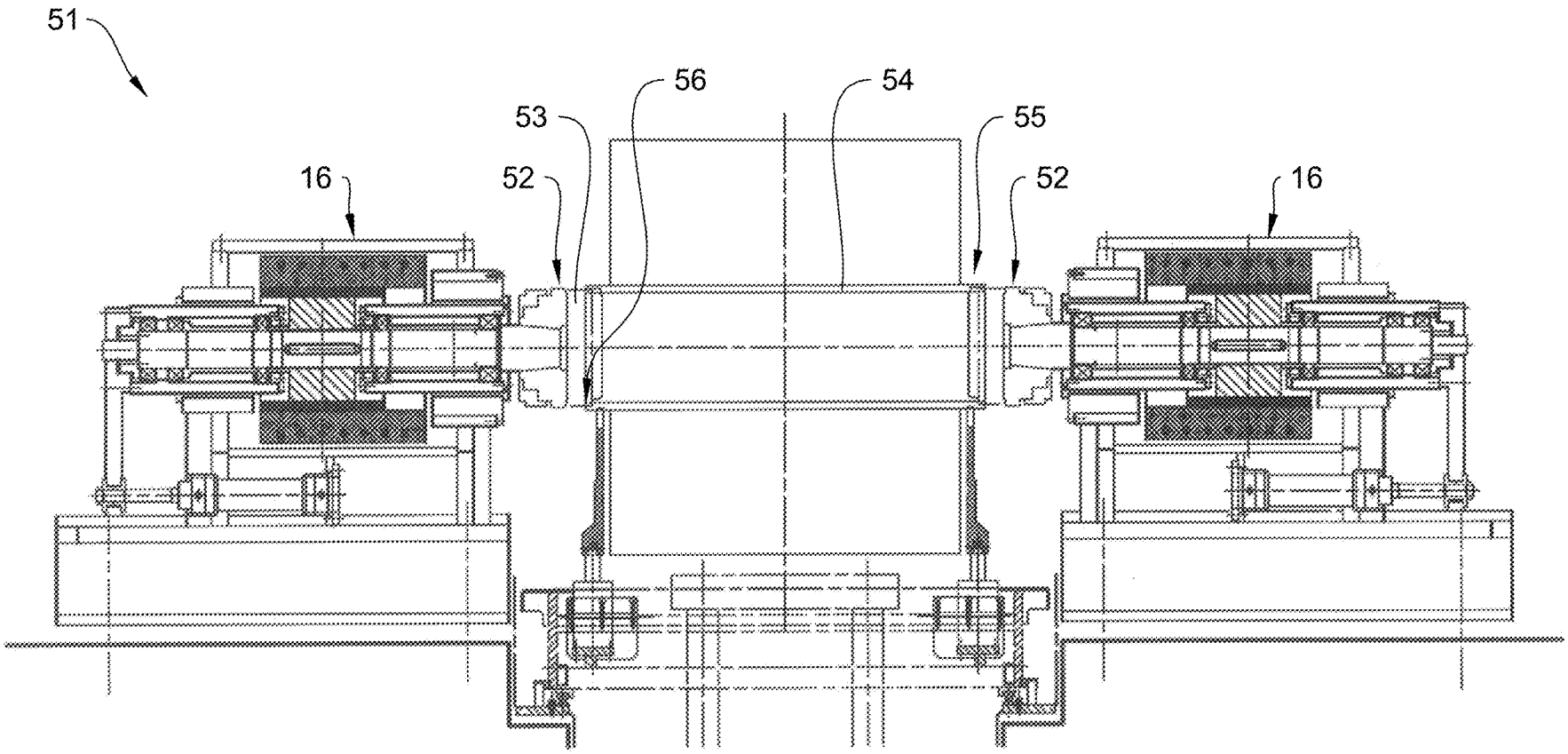
FIG. 3 shows a third embodiment of a reel in a longitudinal sectional view.

FIG. 3 shows a reel 51 on which, in contrast to the reel in FIG. 2, reel heads 52 are provided which form a cone 53 for receiving a coil 54. The coil 54 is formed having an inner cone 56 at its respective ends 55. In this way, the coil 54 can be accommodated on the reel 48 so as to be centered and non-rotatable in a force-fitting manner by clamping it between the reel heads 52.

Figure 4:
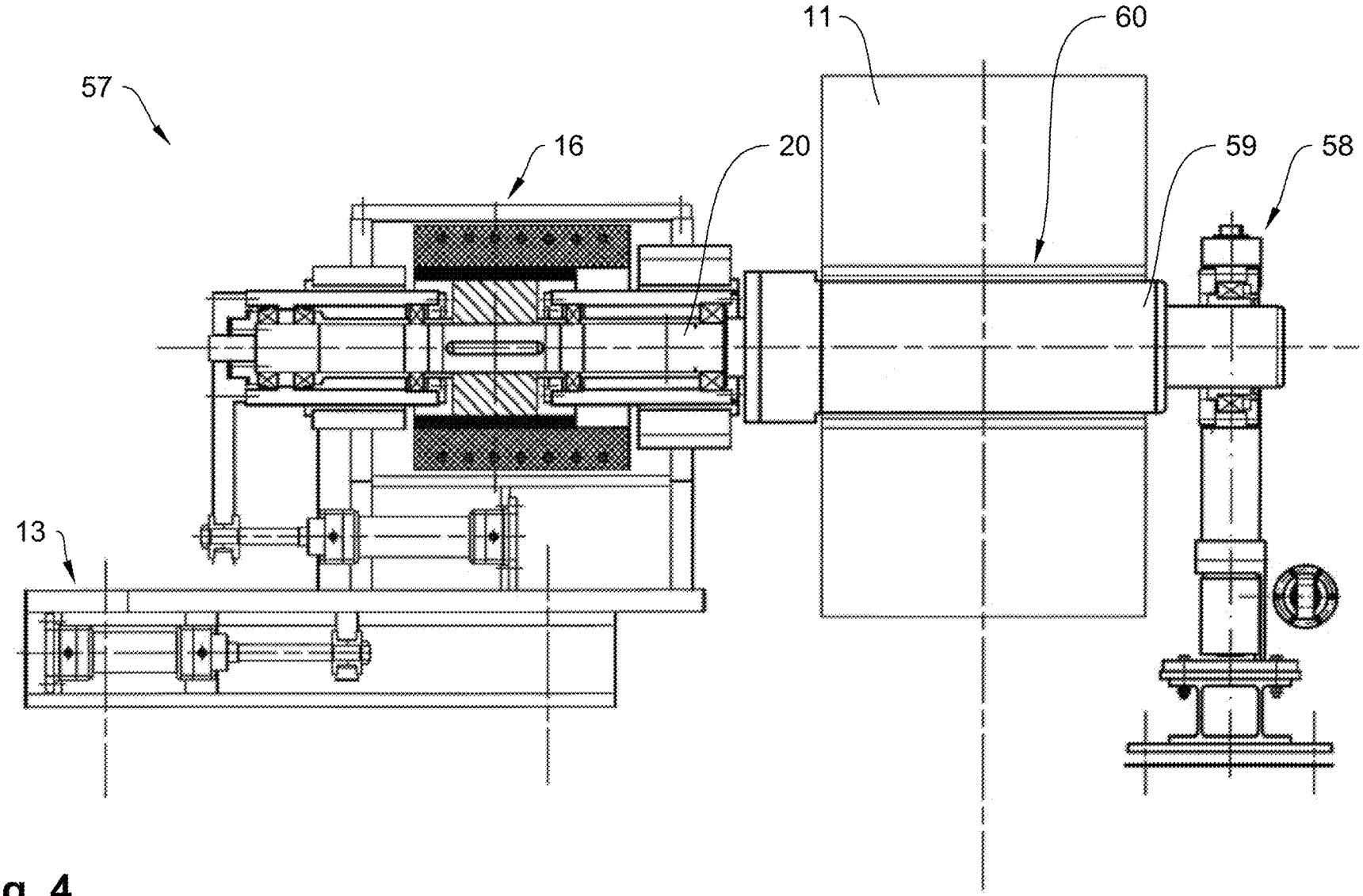
FIG. 4 shows a fourth embodiment of a reel in a longitudinal sectional view.

FIG. 4 shows a reel 57 in which, in contrast to the reel in FIG. 1, only a frame 13 and an electric motor 16 are provided. Instead of an additional electric motor, a counter bearing 58 is provided here. Attached to the shaft 20 of the electric motor 16 is a separating drum 59 for receiving a coil 60 or a coil that has undergone a hot rolling process. In the case of a coil that has undergone a hot rolling process, the material 11 is disposed directly and without the coil 60 on the separating drum 59.

The invention claimed is:

1. A reel for winding or unwinding a strip-shaped material, the reel comprising:

a frame, at least one reel head for disposing a coil for winding or unwinding material, a drive arrangement having at least one electric motor, and a shaft that connects the at least one electric motor to the at least one reel head, the at least one electric motor comprising a stator and a rotor and disposed on the frame, wherein:

the at least one electric motor is a torque motor or a synchronous motor, the shaft connects the rotor directly to the at least one reel head, the rotor being mounted on the stator so as to be axially displaceable relative to the stator, and wherein the stator is formed from a coil package having a plurality of coils and surrounds the rotor, the rotor is formed from a ring package having a plurality of rings, each ring of the plurality of rings having magnets on a circumference thereof, the rings of the plurality of rings being connected to each other, a length ($L_R$) of the ring package being smaller than a length ($L_W$) of the coil package relative to a longitudinal axis of the shaft, and wherein a displacement range (V) of the rotor corresponds to a difference of the lengths ($L_W$, $L_R$).

2. The reel according to claim 1, wherein each of the at least one electric motor comprising the frame and a reel head of the at least one reel head, a coil disposed between reel heads of the at least one reel head, respective coil packages of the at least one electric motor having a corresponding length ($L_W$).

3. The reel according to claim 2, wherein when the at least one electric motor includes multiple electric motors, respective powers of the multiple electric motors differ from one another.

4. The reel according to claim 3, wherein lengths ($L_R$) of ring packages the multiple electric motors are different.

5. The reel according to claim 1, wherein the rings differ from each other in width or are identical in width.

6. The reel according to claim 1, wherein the drive arrangement comprises a tensioning device having an actuator that is configured to axially displace the rotor relative to the stator.

7. The reel according to claim 6, wherein the rotor is disposed on the shaft and mounted on a housing of the stator with the use of radial bearings and at least one axial bearing, wherein a longitudinal guide is formed between each of present bearings and the housing of the stator on either side of the rotor relative to a longitudinal axis of the shaft.

8. The reel according to claim 6, wherein the drive arrangement comprises an additional actuator configured to axially displace the electric motor on an additional longitudinal guide relative to the frame with respect to a longitudinal axis of the shaft, the additional longitudinal guide being formed on the frame.

9. The reel according to claim 1, wherein the at least one electric motor has a housing attached to the frame, and wherein at least one force transducer of a sensing device of a control device of the reel is disposed between the housing and the frame.

10. The reel according to claim 1, wherein the drive arrangement has two reel heads, each reel head of said two reel heads being formed so as to have an expansion head or a cone dimensioned to receive the coil.

11. The reel according to claim 10, wherein the expansion head has an expansion-segment arrangement that includes expansion segments and that is configured to radially tension the coil, and further comprising at least one hydraulic line or a drawbar configured to actuate the expansion segments and disposed within the shaft.

12. A modular system for forming a reel according to claim 1, the modular system comprising a stator formed by a corresponding coil package having a corresponding plurality of coils and a corresponding plurality of rings, each ring having corresponding magnets on a circumference thereof or in insertion pockets directly below the circumference of said each ring, which serve to form a ring package of a rotor, the rings being selected from a first set of rings having a first width and from a second set of rings having a second width that is different from the first width.

13. A method for tensioning a coil for winding or unwinding a strip-shaped material with the use of a reel the method comprising:

with a tensioning device of a drive arrangement of the reel, axially displacing a rotor of at least one electric motor of the drive arrangement relative to a stator of said at least one electric motor, and by said axially displacing, tensioning or releasing the coil disposed between reel heads of the drive arrangement, wherein the at least one electric motor is a torque motor or a synchronous motor.

14. The method according to claim 13, further comprising by said axially displacing, controlling a center of a strip and/or alignment of the venter of the strip before or during a rolling operation.

15. A reel for winding or unwinding a strip-shaped material, the reel comprising:

a frame, at least one reel head for disposing a coil for winding or unwinding material, a drive arrangement having at least one electric motor, and a shaft that connects an electric motor to the reel head, the electric motor comprising a stator and a rotor and disposed on the frame, wherein the electric motor is a torque motor or a synchronous motor, the shaft connects the rotor directly to the reel head, the rotor being mounted on the stator so as to be axially displaceable relative to the stator, wherein the at least one electric motor has a housing attached to the frame, and wherein at least one force transducer of a sensing device of a control device of the reel is disposed between the housing and the frame.

16. The reel according to claim 15, wherein the drive arrangement has two reel heads, each reel head of said two reel heads being formed so as to have an expansion head or a cone dimensioned to receive the coil.

17. The reel according to claim 16, wherein the expansion head has an expansion-segment arrangement that includes expansion segments and that is configured to radially tension the coil, and further comprising at least one hydraulic line or a drawbar configured to actuate the expansion segments and disposed within the shaft.

18. The reel according to claim 15, wherein the drive arrangement comprises a tensioning device having an actuator that is configured to axially displace the rotor relative to the stator.

19. The reel according to claim 18, wherein the rotor is disposed on the shaft and mounted on a housing of the stator with the use of radial bearings and at least one axial bearing, wherein a longitudinal guide is formed between each of present bearings and the housing of the stator on either side of the rotor relative to a longitudinal axis of the shaft.

20. The reel according to claim 18, wherein the drive arrangement comprises an additional actuator configured to axially displace the electric motor on an additional longitudinal guide relative to the frame with respect to a longitudinal axis of the shaft, the additional longitudinal guide being formed on the frame.

* * * * *